US007122283B2

(12) United States Patent
Qi et al.

(10) Patent No.: US 7,122,283 B2
(45) Date of Patent: Oct. 17, 2006

(54) PHOTOCONDUCTIVE MEMBERS

(75) Inventors: Yu Qi, Oakville (CA); Nan-Xing Hu, Oakville (CA); H. Bruce Goodbrand, Hamilton (CA); Ah-Mee Hor, Mississauga (CA); Cheng-Kuo Hsiao, Mississauga (CA); Cuong Vong, Hamilton (CA); Gregory McGuire, Mississauga (CA)

(73) Assignee: Xerox Corporation, Stamford, CT (US)

( * ) Notice: Subject to any disclaimer, the term of this patent is extended or adjusted under 35 U.S.C. 154(b) by 361 days.

(21) Appl. No.: 10/823,913

(22) Filed: Apr. 14, 2004

(65) Prior Publication Data

US 2005/0233235 A1 Oct. 20, 2005

(51) Int. Cl.
*G03G 5/047* (2006.01)
*G03G 5/147* (2006.01)

(52) U.S. Cl. ..... 430/58.2; 430/66; 430/67

(58) Field of Classification Search ..... 430/58.2, 430/66, 67
See application file for complete search history.

(56) References Cited

U.S. PATENT DOCUMENTS

| | | | | |
|---|---|---|---|---|
| 4,265,990 | A | 5/1981 | Stolka et al. | 430/59 |
| 4,555,463 | A | 11/1985 | Hor et al. | 430/59 |
| 4,587,189 | A | 5/1986 | Hor et al. | 430/59 |
| 4,921,769 | A | 5/1990 | Yuh et al. | 430/64 |
| 5,473,064 | A | 12/1995 | Mayo et al. | 540/141 |
| 5,482,811 | A | 1/1996 | Keoshkerian et al. | 430/135 |
| 6,015,645 | A | 1/2000 | Murti et al. | 430/59 |
| 6,117,603 | A * | 9/2000 | Yu et al. | 430/66 |
| 6,156,468 | A | 12/2000 | Wehelie et al. | 430/65 |
| 6,177,219 | B1 | 1/2001 | Yuh et al. | 430/65 |
| 6,203,962 | B1 | 3/2001 | Itami et al. | 430/125 |
| 6,255,027 | B1 | 7/2001 | Wehelie et al. | 430/65 |
| 6,287,737 | B1 | 9/2001 | Ong et al. | 430/58.8 |
| 6,444,386 | B1 | 9/2002 | Liu et al. | 430/64 |
| 6,479,202 | B1 * | 11/2002 | Shida et al. | 430/58.2 |
| 2004/0175637 | A1 * | 9/2004 | Tong et al. | 430/58.2 |

OTHER PUBLICATIONS

Jin Wu et al., U.S. Appl. No. 10/369,812, filed Feb. 19, 2003 on Photoconductive Imaging Members.

* cited by examiner

*Primary Examiner*—Christopher RoDee
(74) *Attorney, Agent, or Firm*—E. O. Palazzo

(57) ABSTRACT

A photoconductive member containing, for example, a substrate, a photogenerating layer, a charge transport layer and an overcoat layer wherein the overcoat layer is comprised of a crosslinked siloxane composite containing a caprolactone-siloxane.

25 Claims, No Drawings

PHOTOCONDUCTIVE MEMBERS

CROSS-REFERENCE TO RELATED APPLICATIONS

Illustrated in copending application U.S. Ser. No. 10/144,147, now abandoned entitled Imaging Members, filed May 10, 2002, the disclosure of which is totally incorporated herein by reference, is a photoconductive imaging member comprised of a supporting substrate, and thereover a single layer comprised of a mixture of a photogenerator component, a charge transport component, an electron transport component, and a polymer binder, and wherein the photogenerating component is a metal free phthalocyanine.

There is illustrated in copending U.S. Ser. No. 10/369,816, U.S. Pat. No. 6,913,863 the disclosure of which is totally incorporated herein by reference, entitled Photoconductive Imaging Members, filed Feb. 19, 2003, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

There is illustrated in copending U.S. Ser. No. 10/369,798, U.S. Pat. No. 6,875,548 entitled Photoconductive Imaging Members, filed Feb. 19, 2003, the disclosure of which is totally incorporated herein by reference, a photoconductive imaging member comprised of an optional supporting substrate, a photogenerating layer, and a charge transport layer, and wherein said charge transport layer is comprised of a charge transport component and a polysiloxane.

There is illustrated in copending U.S. Ser. No. 10/369,812, U.S. Pat. No. 6,824,940 entitled Photoconductive Imaging Members, filed Feb. 19, 2003, the disclosure of which is totally incorporated herein by reference, a photoconductive imaging member containing a hole blocking layer, a photogenerating layer, a charge transport layer, and thereover an overcoat layer comprised of a polymer with a low dielectric constant and charge transport molecules.

The appropriate components and processes of the above copending applications, inclusive of the photogenerating components, the charge transport components such as the hole transport components, the blocking layers, and the adhesive layers can be selected for the present invention in embodiments thereof.

BACKGROUND

This invention is generally directed to imaging members, and more specifically, the present invention is directed to multi-layered photoconductive imaging members with a photogenerating layer, a charge transport layer, an optional hole blocking, or undercoat layer (UCL) and a top overcoat layer comprised of a crosslinked siloxane composite containing a caprolactone-siloxane copolymer group of Formula I wherein $R^1$ and $R^2$ are each a substituent group selected from the group consisting of an alkyl having from 1 to about 6 carbons, a vinyl, and a phenyl; R" represents a divalent linkage organic group, m and n represent the number of repeating segments, wherein m is from about 1 to about 100 and n is from about 1 to about 100, more specifically m is from about 10 to about 50 and n is from about 10 to about 50. More specifically, the present invention relates to photoconductive imaging members comprised of a supporting substrate, a hole blocking layer, an adhesive layer, a photogenerating layer, a charge, especially hole transport layer, and thereover a protective overcoating comprised of a crosslinked siloxane composite containing a caprolactone-siloxane copolymer group of Formula I and wherein there is enabled excellent electrical characteristics, minimization or the avoidance of humidity insensitivity, excellent image quality with substantially no background areas, low surface energy, and when the copolymer also contained in the charge transport layer improved adhesion between the charge transport layer and the overcoating layer. Moreover, in embodiments the overcoating layer illustrated herein can contain metal like alumina, such as alumina nanoparticles, and which particles can improve the durability and the mechanical characteristics of the overcoating layer.

In embodiments the photogenerating layer can be situated between the charge transport layer and the supporting substrate, and the hole blocking layer in contact with the supporting substrate can be situated between the supporting substrate and the photogenerating layer, which is comprised, for example, of the photogenerating pigments of U.S. Pat. No. 5,482,811, the disclosure of which is totally incorporated herein by reference, especially Type V hydroxygallium phthalocyanine, and generally metal free phthalocyanines, metal phthalocyanines, hydroxy gallium phthalocyanines, perylenes, titanyl phthalocyanines, selenium, selenium alloys, azo pigments, squaraines, and the like. The imaging members of the present invention in embodiments exhibit excellent cyclic/environmental stability; excellent wear characteristics; extended lifetimes of, for example, up to 3,000,000 imaging cycles; minimum microcracking; elimination/minimization of adverse affect when contacted with a number of solvents such as methylene chloride, tetrahydrofuran and toluene; acceptable and in some instances improved electrical characteristics; excellent imaging member surface properties; and which members can be selected for both drum and belt photoreceptors.

Processes of imaging, especially xerographic imaging, and printing, including digital, are also encompassed by the present invention. More specifically, the photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 475 to

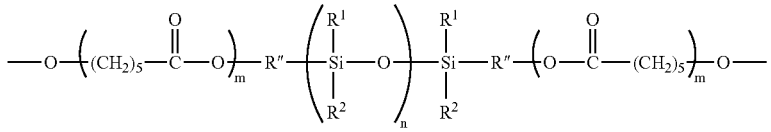

(I)

about 950 nanometers, and in particular from about 650 to about 850 nanometers, thus diode lasers can be selected as the light source. Moreover, the imaging members of this invention are useful in color xerographic applications, particularly high-speed color copying and printing processes.

Related Patents

Illustrated in U.S. Pat. No. 6,444,386, the disclosure of which is totally incorporated herein by reference, is a photoconductive imaging member comprised of an optional supporting substrate, a hole blocking layer thereover, a photogenerating layer, and a charge transport layer, and wherein the hole blocking layer is generated from crosslinking an organosilane (I) in the presence of a hydroxy-functionalized polymer (II)

(I)

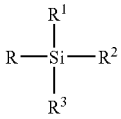

(II)

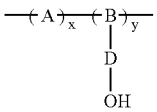

wherein R is alkyl or aryl, $R^1$, $R^2$, and $R^3$ are independently selected from the group consisting of alkoxy, aryloxy, acyloxy, halide, cyano, and amino; A and B are, respectively, divalent and trivalent repeating units of polymer (II); D is a divalent linkage; x and y represent the mole fractions of the repeating units of A and B, respectively; and wherein x is from about 0 to about 0.99; y is from about 0.01 to about 1, and wherein the sum of x+y is equal to about 1.

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II), and water (I)

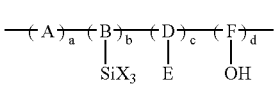

(II)

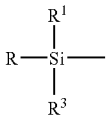

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and more specifically about 4 parts $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid, and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components and processes of the above patents may be selected for the present invention in embodiments thereof.

References

Illustrated in U.S. Pat. No. 6,203,962, the disclosure of which is totally incorporated herein by reference, are photoconductive imaging members with certain silicon type overcoats.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an arylamine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

The uses of a number of pigments in the photogenerating layer perylene pigments as photoconductive substances is known. Also, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468, the disclosure of which is totally incorporated herein by reference, wherein there is illustrated a hole blocking layer of titanium dioxide dispersed in a specific linear phenolic binder of VARCUM™, available from OxyChem Company.

A number of photoconductive members and components thereof are illustrated in U.S. Pat. Nos. 4,988,597; 5,063,128; 5,063,125; 5,244,762; 5,612,157; 6,218,062; 6,200,716 and 6,261,729, the disclosures of which are totally incorporated herein by reference.

SUMMARY

It is a feature of the present invention to provide imaging members with many of the advantages illustrated herein, such as extended lifetimes of over, for example, 3,000,000 imaging cycles; excellent electronic characteristics; stable properties; microcracking, for example, minimal cracks visible with magnification; low surface energy; improved water contact angles, for example about 99 degrees as compared to 85 degrees for a similar control device, and the like.

Another feature of the present invention relates to the provision of layered photoresponsive imaging members, which are responsive to near infrared radiation of from about 700 to about 900 nanometers.

It is yet another feature of the present invention to provide layered photoresponsive imaging members with sensitivity to visible light.

Moreover, another feature of the present invention relates to the provision of layered photoresponsive imaging members with mechanically robust and solvent resistant overcoat layers.

Aspects of the present disclosure relate to a photoconductive member comprised of a substrate, a photogenerating layer, a charge transport layer, and an overcoat layer wherein the overcoat layer is comprised of a crosslinked siloxane composite containing a caprolactone-siloxane copolymer group; a photoconductive imaging member comprised of a substrate comprised of a conductive metal of aluminum, aluminized polyethylene terephthalate or titanized polyethylene terephthalate; a photogenerating layer comprised of hydroxygallium phthalocyanine or chlorogallium phthalocyanine; a charge transport layer containing N,N'-diphenyl-N,N-bis(3-methyl phenyl)-1,1'-biphenyl-4,4'-diamine and/or N,N-bis(3,4-dimethyl phenyl)-N-biphenylamine, and a binder of a polycarbonate; and an overcoat layer, wherein said overcoat layer is comprised of a crosslinked siloxane composite containing a caprolactone-siloxane copolymer of the formula

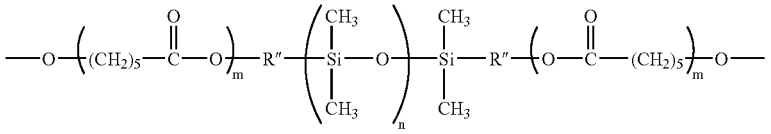

wherein m and n represent the number of repeating groups, for example m is from about 10 to about 50, and n is from about 10 to about 50; a photoconductive component comprised of a photogenerating layer, a charge transport layer, and an overcoat layer wherein said overcoat layer is comprised of a crosslinked siloxane composite containing a caprolactone-siloxane polymer, and wherein said caprolactone-siloxane copolymer is of the formula

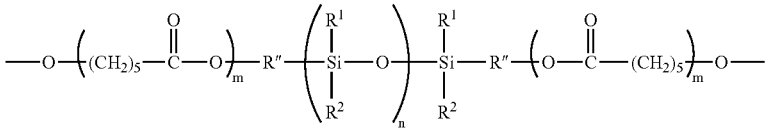

wherein $R^1$ and $R^2$ are each alkyl, aryl; R" represents an organic component; and m and n represent the number of repeating groups; a photoconductive member wherein the supporting substrate is comprised of a conductive metal substrate; a photoconductive imaging member wherein the conductive substrate is aluminum, aluminized polyethylene terephthalate or a titanized polyethylene; a photoconductive imaging member wherein the photogenerator layer is of a thickness of from about 0.05 to about 10 microns; a photoconductive imaging member wherein the charge, such as hole transport layer, is of a thickness of from about 10 to about 50 microns; a photoconductive imaging member wherein the photogenerating layer is comprised of photogenerating pigments dispersed in an optional resinous binder in an amount of from about 5 percent by weight to about 95 percent by weight; a photoconductive imaging member wherein the photogenerating resinous binder is selected from the group consisting of copolymers of vinyl chloride, vinyl acetate and hydroxy and/or acid containing monomers, polyesters, polyvinyl butyrals, polycarbonates, polystyrene-b-polyvinyl pyridine, and polyvinyl formals; a photoconductive imaging member wherein the charge transport layer comprises aryl amine molecules; a photoconductive imaging member wherein the charge transport aryl amines are, for example, of the formula

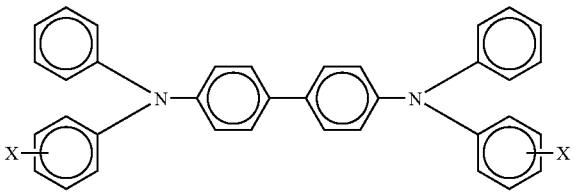

wherein X is selected from the group consisting of alkyl, alkoxy, and halogen, and wherein the aryl amine is dispersed in a resinous binder; a photoconductive imaging member wherein the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, alkylhydroxygallium phthalocyanines, hydroxygallium phthalocyanines, or mixtures thereof; a photoconductive imaging member wherein the photogenerating layer is comprised of Type V hydroxygallium phthalocyanine; a method of imaging which comprises generating an electrostatic latent image on the imaging member illustrated herein, developing the latent image, and transferring the developed electrostatic image to a suitable substrate; an imaging member wherein the hole blocking layer phenolic compound is bisphenol S, 4,4'-sulfonyldiphenol; an imaging member wherein the phenolic compound is bisphenol A, 4,4'-isopropylidenediphenol; an imaging member wherein the phenolic compound is bisphenol E, 4,4'-ethylidenebisphenol; an imaging member wherein the phenolic compound is bisphenol F, bis(4-hydroxyphenyl)methane; an imaging member wherein the phenolic compound is bisphenol M, 4,4'-(1,3-phenylenediisopropylidene) bisphenol; an imaging member wherein the phenolic compound is bisphenol P, 4,4'-(1,4-phenylenediisopropylidene) bisphenol; an imaging member wherein the phenolic compound is bisphenol Z, 4,4'-cyclohexylidenebisphenol; an imaging member wherein the phenolic compound is hexafluorobisphenol A, 4,4'-(hexafluoroisopropylidene) diphenol; an imaging member wherein the phenolic compound is resorcinol, 1,3-benzenediol; an imaging member comprised in the sequence of a supporting substrate, a hole blocking layer, an optional adhesive layer, a photogenerating layer, a hole transport layer and the overcoating layer as illustrated herein; an imaging member wherein the adhesive layer is comprised of a polyester with an $M_w$ of about 40,000 to about 75,000, and an $M_n$ of from about 30,000 to about 45,000; an imaging member wherein the photogenerator layer is of a thickness of from about 1 to about 5 microns, and wherein the transport layer is of a thickness of from about 20 to about 65 microns; an imaging member wherein the photogenerating layer is comprised of photogenerating pigments dispersed in a resinous binder in an amount of from about 10 percent by weight to about 90 percent by weight, and optionally wherein the resinous binder is selected from the group comprised of vinyl chloride/vinyl acetate copolymers, polyesters, polyvinyl butyrals, polycarbonates, polystyrene-b-polyvinyl pyridine, and polyvinyl formals; an imaging member wherein the charge transport layer comprises suitable known or future developed components; an imaging member wherein the photogenerating layer is comprised of metal phthalocyanines, or metal free phthalocyanines; an imaging member wherein the photogenerating layer is comprised of titanyl phthalocyanines, perylenes, or hydroxygallium phthalocyanines; an imaging member wherein the photogenerating layer is comprised of Type V hydroxygallium phthalocyanine; a method of imaging which comprises generating an electrostatic latent image on the imaging member illustrated herein, developing the latent image with a known toner, and transferring the developed electrostatic image to a suitable substrate like paper.

In embodiments, the crosslinked siloxane is a composite containing a caprolactone-siloxane copolymer group of the formula

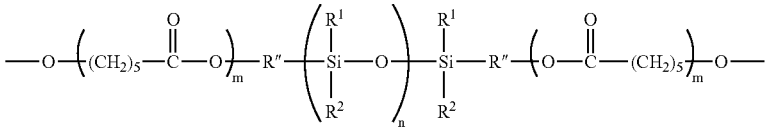

(I)

wherein $R^1$ and $R^2$ are each a substituent group selected from the group consisting of aryl, such as phenyl, an alkyl with, for example, from 1 to about 6 carbons, a vinyl, and the like; R" represents a divalent linkage or linking organic group; m and n represent the number of repeating segments or groups, wherein m is from about 1 to about 100 and n is from about 1 to about 100, and more specifically, m is from about 10 to about 50 and n is from about 10 to about 50. Examples of an alkyl of $R^1$ and $R^2$ are methyl, ethyl, propyl, isopropyl, butyl and the like; divalent linkage examples of R" are selected, for example, from the group consisting of alkylene with, for example, from about 1 to about 24 carbon atoms, such as methylene, dimethylene, trimethylene, tetramethylene, hexamethylene, and the like; and other suitable divalent groups many of which are known.

In embodiments, the overcoat layer is comprised of a crosslinked siloxane composite formed from the reaction of a silane compound, a hole transport component, and a caprolactone-siloxane copolymer of

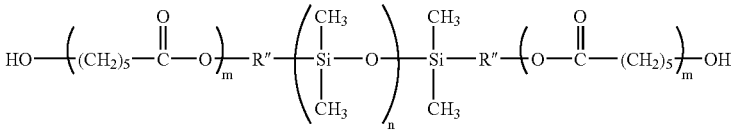

(II)

wherein R" represents a divalent linkage organic group; m and n represent the number of repeating segments wherein m is from about 5 to about 100 and n is from about 10 to about 50. Typically, R" is selected from a group consisting of methylene, dimethylene, trimethylene, tetramethylene, hexamethylene and the like, more specifically R" is dimethylene and trimethylene.

The block copolymer of Formula II can be purchased from Gelest, Inc. and the molecular weight ($M_w$) of the block copolymer is, for example, from about 5,700 to about 6,900, and the non-siloxane content is, for example, about 50 weight percent. The incorporation of the block copolymer into the siloxane crosslinked protective overcoat layer offers, for example, low surface energy, provides excellent adhesive between the transporting layer and the protective layer, and enables excellent photoconductive electrical properties.

In embodiments, the silane compound is of (III) or (IV)

$$R—Si(X)_nY_{3-n} \quad (III)$$

$$Y_{3-n}(X)_nSi—R'—Si(X)_nY_{3-n} \quad (IV)$$

wherein R and X each independently represents an organic group with a carbon atom directly bonded to silicon atom; R' represents a divalent organic group; Y represents a hydrolyzable group; and n is an integer of 0, 1 and 2. Examples of R and X are alkyl with, for example, 1 to about 30 carbon atoms, for example methyl, ethyl, propyl, butyl, isopropyl, tert-butyl, pentyl, hexyl, heptal, octal, dodecyl and the like; a halogen-substituted alkyl with, for example, from about 1 to about 30 carbon atoms like trifluoromethyl, trifluoroethyl, trifluoropropyl, tridecafluoro-1,1,2,2-tetrahydrooctyl, chloromethyl and the like; an aryl with, for example, from about 6 to about 60 carbon atoms, such as phenyl, benzyl, tolyl, ethylphenyl, biphenyl, naphthyl and the like. R and X may also comprise an epoxy, such as y-glycidoxypropyl and β-(3,4-epoxycyclohexyl)ethyl group, an amino group, such as γ-aminopropyl, a hydroxyl group, such as a γ-hydroxypropyl, a 2,3-dihydroxypropyloxypropyl group, a (metha) acryloxy group, such as a γ-acryloxypropyl, a γ-methacryloxypropyl group, a vinyl group, such as a vinyl, a propenyl group, and a mercapto group, such as a γ-mercaptopropyl group.

R' is, for example, an alkylene with, for example, from about 1 to about 30 carbon atoms, such as methylene, dimethylene, trimethylene, tetramethylene, hexamethylene and the like; an arylene carbon with, for example, from about 6 to about 60 carbons, such as phenylene, biphenylene, methylenephenylene, phenyldimethylene, oxydiphenylene, and the like. Examples of Y include an alkoxy group with, for example, from about 1 to about 10 carbons, such as methoxy, ethoxy, propoxy, butoxy, methoxyethoxy and the like; a methylethyl ketoxime, a diethylamino, an acetoxy, an allyl and the like.

Generally, the hole transport component for the charge transport layer is of Formula (V) or (VI)

$$A—(Z—OH)_m \quad (V)$$

$$A—[Z—Si(X)_nY_{3-n}]_m \quad (VI)$$

wherein A represents a charge transport moiety; Z represents a single bond linkage or a divalent linkage organic group; X represents an organic group with a carbon atom directly bonded to silicon atom; Y represents a hydrolyzable group, n is 0, 1 and 2 and m is a number, more specifically selected from about 1 to about 5.

Typical examples of hole transport moiety A include pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl) carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. However, to avoid cycle-up in machines with high throughput, the charge transport layer should be substantially free (less than about two percent) of di or triaminotriphenyl methane. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine.

Typical examples of Z include a single bond, a divalent linkage comprised of an alkylene having carbon atoms with, for example, from about 1 to about 30, for example methylene, dimethylene, trimethylene, tetramethylene, hexamethylene and the like; an arylene having carbon atoms with, for example, from about 6 to about 60, for example phenylene, biphenylene, methylenephenylene, phenyldimethylene, oxydiphenylene, and the like.

Typical examples of Y include an alkoxy group having carbon atoms with, for example, from about 1 to about 10, for example methoxy, ethoxy, propoxy, butoxy, methoxyethoxy and the like; a methylethyl ketoxime, a diethylamino, a acetoxy and the like.

Illustrated specific examples of A can be

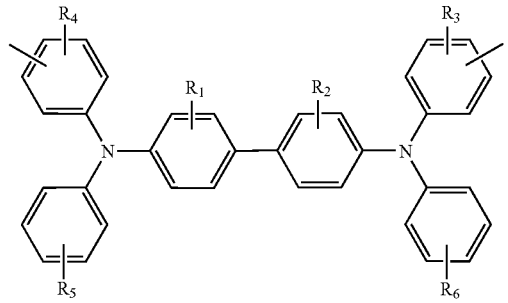

-continued
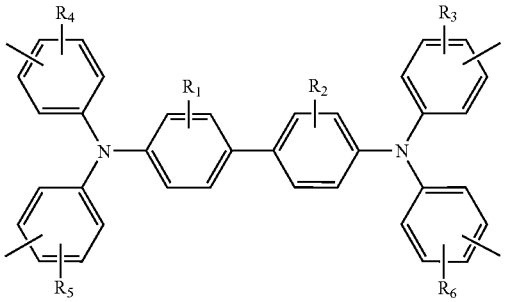
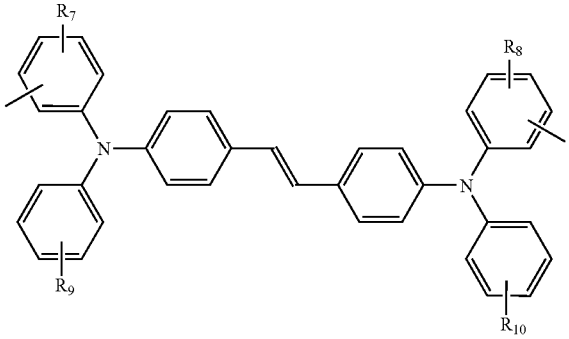
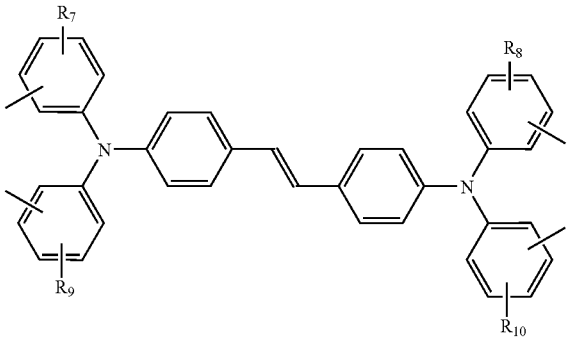
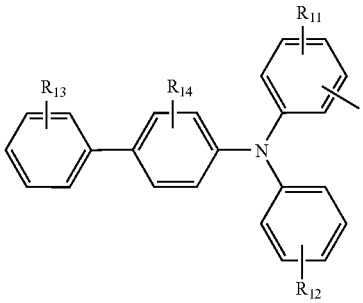
-continued
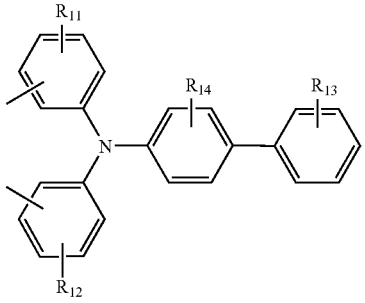
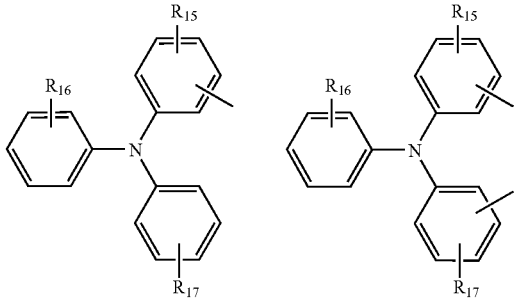
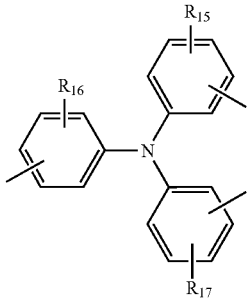
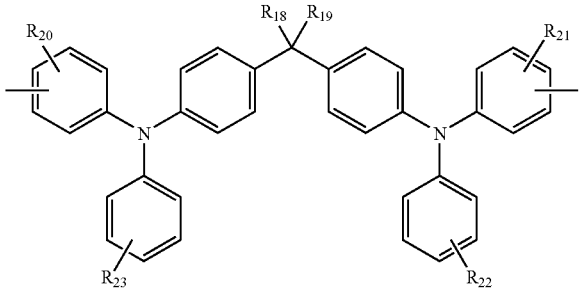
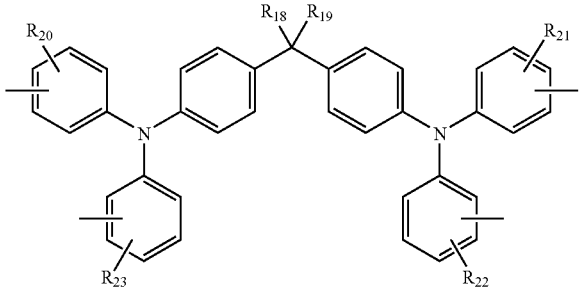

wherein $R_1$ to $R_{23}$ are independently selected from a hydrogen atom, an alkyl, a cyclic alkyl, and a halogen atom wherein alkyl groups containing, for example, from 1 to about 25 carbon atoms, cyclohexyl group, a chloride, and a bromide.

Specific examples of aromatic amines A include N,N'-biphenyl-N,N'-bis(alkylphenyl)-(1,1'-biphenyl)-4,4'-diamine wherein alkyl is, for example, methyl, ethyl, propyl, n-butyl, or the like, N-phenyl-N-alkylphenyl-N-biphenylamine wherein alkyl is, for example, methyl, ethyl, propyl, n-butyl, or the like, tri-alkylphenylamine wherein alkyl is, for example, methyl, ethyl, propyl, n-butyl, or the like, or N,N'-biphenylstilbene-N,N'-bis(alkylphenyl)-(1,1'-biphenylstilbene)-4,4'-diamine wherein alkyl is, for example, methyl, ethyl, propyl, n-butyl, or the like.

The crosslinked siloxane composite optionally includes nano-sized fillers, for example metal oxide nanoparticles, more specifically, the metal oxides include silicon oxide, aluminum oxide, titanium oxide, chromium oxide, zirconium oxide, zinc oxide, tin oxide, iron oxide, magnesium oxide, manganese oxide, nickel oxide, copper oxide, indium tin oxide, and mixtures thereof. Examples of nano-size fillers include fillers having an average particle size of from about 1 to about 250 nanometers, or from about 1 to about 199 nanometers, or from about 1 to about 195 nanometers, or from about 1 to about 175 nanometers, or from about 1 to about 150 nanometers, or from about 1 to about 100 nanometers, or from about 1 to about 50 nanometers. The nano-sized fillers further reduce marring, scratching, abrasion and wearing of the surface and hence extend service life of imaging members.

The crosslinked siloxane composite overcoat can be prepared by sol-gel process, reference U.S. Pat. No. 5,116,703, the disclosures of which are totally incorporated herein by reference The silane compound is present in an amount of from about 20 to about 80 weight percent, preferably from about 30 to about 70 weight percent; the caprolactone-dimethylsiloxane-caprolactone block copolymer of Formula II is present in an amount of from about 0.1 to about 30 weight percent, more specifically from about 0.5 to about 20 weight percent; the hole transport molecule is present in an amount of from about 5 to about 60 weight percent, preferably from about 10 to about 50 weight percent; optionally the nano-sized metal oxide particles, such as alumina nanoparticles, are present in an amount of from about 1 to about 40 weight percent, more specifically from about 2 to about 30 weight percent. The total amount of all components in the crosslinked siloxane composite equals about 100 weight percent.

A thin film of silicon hardcoat overcoat layer can be prepared by mixing the components including a silane molecule or a mixture of silane molecules, the block copolymer, a hole transport molecule in a solvent such as methanol, ethanol, isopropanol, butanol and the like in the presence of an acid or a base. The mixture is hydrolyzed, condensed and dried to form a 3-dimension network, which provides high hardness, low surface energy, hole transport, adhesion with the layer underneath, and further provides abrasion resistance, smooth, transparency and good electrical characteristics. The thickness of the overcoat layer is from about 0.5 to about 10 microns, more specifically from about 1 to about 8 microns. Scheme 1 illustrates the formation of 3-dimensional networks.

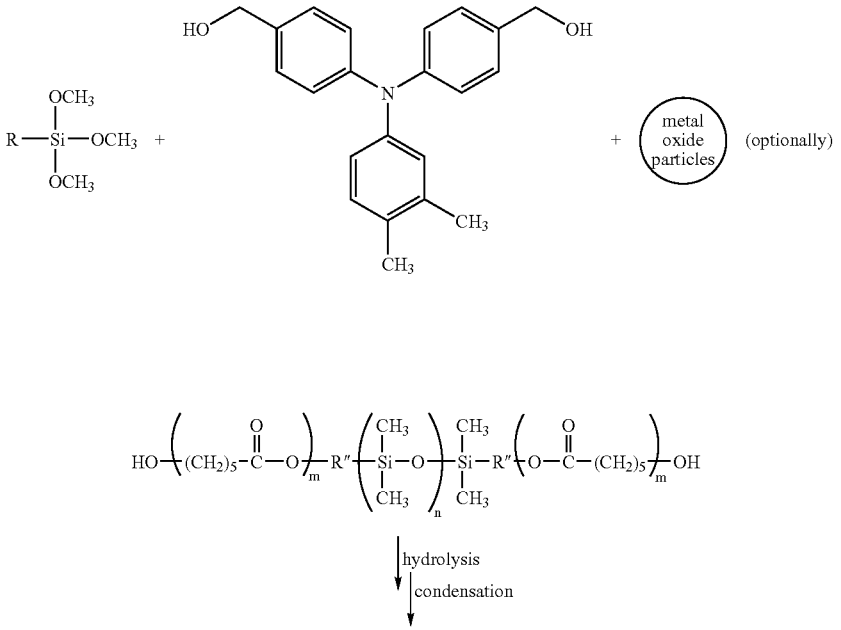

-continued

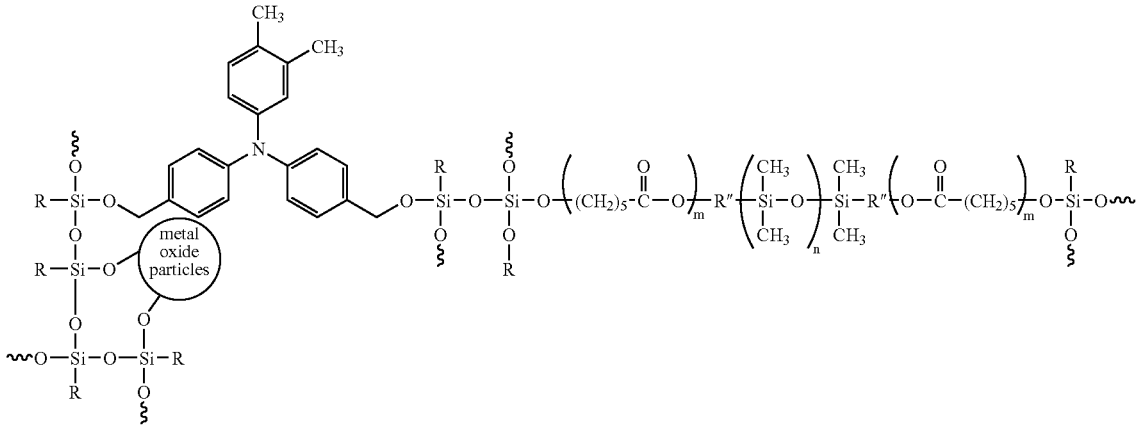

The water contact angle measures the angle between a substrate surface, such as a P/R, and the far side of water drop deposited onto this surface. A drop of water that does not interface well with the substrate is hydrophobic towards it and will retain its spherical shape, leading to a high contact angle. Conversely, if the water is compatible with the substrate, it is hydrophilic and will disperse on the substrate surface, losing its spherical shape leading to a small contact angle. Since water has a high surface tension, any hydrophobic substrate will counter this effect by possessing a low surface tension, which corresponds to a lower surface energy and leads to a reduction in friction and water absorption. A surface that is lower in friction is easier to clean and less susceptible to mechanical wear.

The water contact angle analysis was performed on a DAT1100 FIBRO system ab dynamic contact angle and absorption tester. A micro-pipette deposited a set volume of water onto the P/R surface and monitored its settling over a period of 1.00 s. The resulting silicon hardcoat overcoat layer containing the caprolactone-dimethylsiloxane-caprolactone block copolymer shows increased water contact angle by about 10° to about 20°, compared with the control containing no such OCL.

Illustrative examples of substrate layers selected for the imaging members of the present invention include known substrates, and which substrates can be opaque, substantially transparent, transparent, and the like, such as a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The thickness of the substrate layer depends on many factors, including economical considerations, thus this layer may be of substantial thickness, for example over 3,000 microns, such as from about 350 to about 700 microns, or of minimum thickness providing there are no significant adverse effects on the member. In embodiments, the thickness of this layer is from about 75 microns to about 300 microns.

The photogenerating layer, which can, for example, be comprised of hydroxygallium phthalocyanine Type V, is in embodiments comprised of, for example, about 60 weight percent of Type V and about 40 weight percent of a resin binder like polyvinylchloride vinylacetate copolymer such as VMCH (Dow Chemical). The photogenerating layer can contain known photogenerating pigments, such as metal phthalocyanines, metal free phthalocyanines, alkylhydroxyl gallium phthalocyanines, hydroxygallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder is present. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesive layers usually in contact with the hole blocking layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention further desirable electrical and optical properties.

A number of known components, especially molecules, can be selected for the charge transport layer, which generally is of a thickness of from about 5 microns to about 75 microns, and more specifically, of a thickness of from about 10 microns to about 40 microns, such as aryl amines, of the following formula

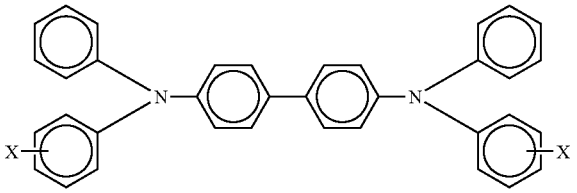

dispersed in a highly insulating and transparent polymer binder, wherein X is an alkyl group, an alkoxy group, aryl, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example, U.S. Pat. Nos. 4,921,773 and 4,464,450, the disclosures of which are totally incorporated herein by reference.

Examples of the binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes, poly(cyclo olefins), and epoxies as well as block, random or alternating copolymers thereof. Preferred electrically inactive binders are comprised of polycarbonate resins with a molecular weight of from about 20,000 to about 100,000 with a molecular weight $M_w$ of from about 50,000 to about 100,000 being particularly preferred. Generally, the transport layer contains from about 10 to about 75 percent by weight of the charge transport material, and more specifically, from about 35 percent to about 50 percent of this material.

The hole blocking or undercoat layers for the imaging members of the present invention contain a number of components including known hole blocking components, such as silanes, doped metal oxides, TiSi, a metal oxide like titanium, chromium, zinc, tin and the like, a mixture of phenolic compounds and a phenolic resin or a mixture of 2 phenolic resins, and optionally a dopant such as $SiO_2$. The phenolic compounds contain at least two phenol groups, such as bisphenol A(4,4'-isopropylidenediphenol), E(4,4'-ethylidenebisphenol), F(bis(4-hydroxyphenyl)methane), M(4,4'-(1,3-phenylenediisopropylidene)bisphenol), P(4,4'-(1,4-phenylene diisopropylidene)bisphenol), S(4,4'-sulfonyldiphenol), Z(4,4'-cyclohexylidenebisphenol); hexafluorobisphenol A(4,4'-(hexafluoro isopropylidene)diphenol), resorcinol; hydroxyquinone, catechin, and the like.

The hole blocking layer can be, for example, comprised of from about 20 weight percent to about 80 weight percent, and more specifically, from about 55 weight percent to about 65 weight percent of a metal oxide, such as $TiO_2$, from about 20 weight percent to about 70 weight percent, more specifically, from about 25 weight percent to about 50 weight percent of a phenolic resin, from about 2 weight percent to about 20 weight percent, more specifically, from about 5 weight percent to about 15 weight percent of a phenolic compound preferably containing at least two phenolic groups, such as bisphenol S, and from about 2 weight percent to about 15 weight percent, more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (OxyChem Company) and DURITE™ 97 (Borden Chemical), formaldehyde polymers with ammonia, cresol and phenol, such as VARCUM™ 29112 (OxyChem Company), formaldehyde polymers with 4,4'-(1-methylethylidene) bisphenol, such as VARCUM™

29108 and 29116 (OxyChem Company), formaldehyde polymers with cresol and phenol, such as VARCUM™ 29457 (OxyChem Company), DURITE™ SD-423A, SD-422A (Borden Chemical), or formaldehyde polymers with phenol and p-tert-butylphenol, such as DURITE™ ESD 556C (Border Chemical).

Also included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same aforementioned sequence with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

An illustrative photoresponsive imaging device was fabricated as follows.

On a 75 micron thick titanized MYLAR® substrate was coated by draw bar technique a barrier layer formed from hydrolyzed gamma aminopropyltriethoxysilane having a thickness of 0.005 micron. The barrier layer coating composition was prepared by mixing 3-aminopropyltriethoxysilane with ethanol in a 1:50 volume ratio. The coating was allowed to dry for 5 minutes at room temperature, about 22° C. to about 25° C., followed by curing for 10 minutes at 110° C. in a forced air oven. On top of the blocking layer was coated a 0.05 micron thick adhesive layer prepared from a solution of 2 weight percent of an E.I. DuPont 49K (49,000) polyester in dichloromethane. A 0.2 micron photogenerating layer was then coated on top of the adhesive layer from a dispersion of hydroxy gallium phthalocyanine Type V (0.46 gram) and a polystyrene-b-polyvinylpyridine block copolymer binder (0.48 gram) in 20 grams of toluene, followed by drying at 100° C. for 10 minutes. Subsequently, a 24 μm thick charge transport layer (CTL) was coated on top of the photogenerating layer from a solution of N,N'-diphenyl-N,N-bis(3-methylphenyl)-1,1'-biphenyl-4,4'-diamine (3.6 grams) and a polycarbonate, PCZ-400 [poly(4,4'-dihydroxydiphenyl-1-1-cyclohexane), $M_w$=40,000] available from Mitsubishi Gas Chemical Company, Ltd. (5.4 grams) in a mixture of 21.6 grams of tetrahydrofuran (THF) and 7.2 grams of toluene. The CTL was dried at 120° C. for 45 minutes.

A thin film of a silicon hardcoat overcoat layer was coated on top of the charge transport layer (CTL) from a solution of caprolactone-dimethylsiloxane-caprolactone block copolymer and the above diamine hole transport molecules. The aforementioned sol-gel solution was prepared by mixing methyltrimethoxysilane (20 grams), a 1 percent solution of acetic acid in deionized water (11.7 grams) and 1-butanol (27.7 grams), followed by stirring at a temperature of 65° C. for 2 hours, then adding 30 grams of 1-butanol and stirring an additional 96 hours. The sol-gel solution (5.5 grams), the block copolymer (0.5 gram), the hole transport molecules above or IV-a (4 grams) and aluminum acetylacetonate (0.025 gram) was stirred at room temperature for 24 hours. The resulting homogeneous solution was coated on the top of the above charge transport layer. After coating, the resulting device was dried and cured at 135° C. for 30 minutes to provide an imaging member with a 6.2 micron thick silicon hard coat overcoat that was resistant (minimal device degradation) to common organic solvents such as, for example, methylenechloride, methanol, ethanol and the like, and which device was robust and abrasion resistant as determined by an abrasion test with known toner particles of a styrene butylmethacrylate resin and REGAL 330® carbon black.

IV-a

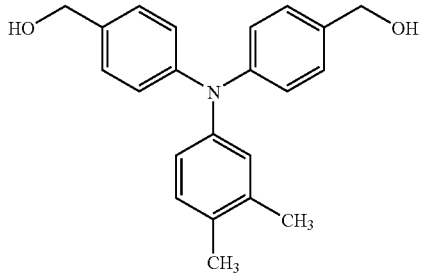

The xerographic electrical properties of imaging members or devices can be determined by known means, including as indicated herein electrostatically charging the surfaces thereof with a corona discharge source until the surface potentials, as measured by a capacitively coupled probe attached to an electrometer, attained an initial value $V_o$ of about −800 volts. After resting for 0.5 second in the dark, the charged members attained a surface potential of $V_{ddp}$, dark development potential. Each member was then exposed to light from a filtered Xenon lamp with a XBO 150 watt bulb, thereby inducing a photodischarge which resulted in a reduction of surface potential to a $V_{bg}$ value, background potential. The percent of photodischarge was calculated as $100\times(V_{ddp}-V_{bg})/V_{ddp}$. The desired wavelength and energy of the exposed light was determined by the type of filters placed in front of the lamp. The monochromatic light photosensitivity was determined using a narrow band-pass filter.

Photoreceptor wear was determined by the difference in the thickness of the photoreceptor or device before and after the wear test. For the thickness measurement, the photoreceptor was mounted onto a sample holder to zero the permascope at the uncoated edge of the photoreceptor. Then its thickness was measured at every one-inch interval from the top edge of the coating along its length using the permascope, ECT-100, to obtain an average thickness value.

The following table summarizes the electrical and the wear test performance of these devices wherein OCL represents the overcoating layers.

| Device | $V_{ddp}$ (−V) | $E_{1/2}$ (Ergs/cm)$^2$ | Dark Decay (V @ 500 ms) | Vr (V) | WEAR (nm/k cycles) |
|---|---|---|---|---|---|
| Control Device Without OCL | 806 | 1.80 | 8 | 3 | 41.5 |
| Device with OCL | 808 | 2.00 | 11 | 5 | 32.4 |

The water contact angle of this OCL was 99.5°, while the water contact angle of control without the OCL was 85.20. The OCL device with toner exhibited a lower surface energy as compared to the same device without the overcoat.

EXAMPLE II

A photoresponsive device incorporating a silicon hardcoat overcoat layer with the same formulation of Example I but containing alumina nanoparticles was fabricated in substantially the same manner as the device in Example I. A thin film of silicon hardcoat overcoat layer was coated on top of a charge transport layer from a dispersion of alumina nanoparticles in a solution of the sol-gel of the above Example I caprolactone-dimethylsiloxane-caprolactone block copolymer, and hole transport molecules IV-a. The sol-gel solution was prepared by mixing methyltrimethoxysilane (20), a 1 percent solution of acetic acid in deionized water (11.7 grams) and 1-butanol (27.7 grams), followed by stirring at a temperature of 65° C. for 2 hours, then adding 30 grams of 1-butanol and stirring an additional 96 hours. By sonication, the alumina nanoparticles (0.10 gram) were dispersed into the solution containing the sol-gel solution (5.5 grams), the block copolymer (0.5 gram), hole transport molecules (IV-a, 4 grams) and aluminum acetylacetonate (0.025 gram). The resulting dispersion was stirred at room temperature (about 22° C. to about 25° C.) for 24 hours. The resulting uniform dispersion was coated on the top of the charge transport layer. After coating, the resulting device was dried and cured at 135° C. for 30 minutes to provide an imaging member with a 4.4 micron thick silicon hard coat overcoat with penetration or degradation resistance to common organic solvents such as, for example, methylene chloride, methanol, ethanol and the like, and which device was robust and abrasion resistant as determined by an abrasion test with toner particles.

IV-a

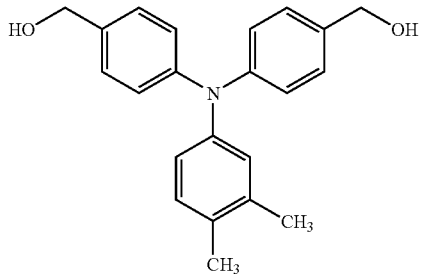

The following table summarizes the electrical and the wear test performance of the above prepared device or photoconductive imaging member.

| Device | $V_{ddp}$ (V) | $E_{1/2}$ (Ergs/cm)$^2$ | Dark Decay (V @ 500 ms) | Vr (V) | WEAR (nm/k cycles) |
|---|---|---|---|---|---|
| Control Device with no OCL | 806 | 1.80 | 8 | 3 | 41.5 |
| Device with alumina nanoparticle containing silicon hardcoat OCL | 808 | 2.13 | 8.0 | 5 | 11.8 |

The water contact angle of the device with the OCL was 98.90, while the water contact angle of a control without the OCL was 85.2°.

EXAMPLE III

A photoresponsive imaging device incorporating a silicon hardcoat overcoat layer with the same formulation of Example II but containing less amount of the block copolymer (0.3 gram) was fabricated in the same manner as the device in Example II. The OCL thickness was 5.6 microns. The following table summarizes the electrical and the wear test performance of this device.

| Device | $V_{ddp}$ (V) | $E_{1/2}$ (Ergs/cm)$^2$ | Dark Decay (V @ 500 ms) | Vr (V) | WEAR (nm/k cycles) |
|---|---|---|---|---|---|
| Control Device Without OCL | 806 | 1.80 | 8.0 | 3 | 41.5 |
| Device with alumina nanoparticle containing silicon hardcoat OCL | 807 | 2.10 | 8.0 | 4 | 9.7 |

The water contact angle of the device with the OCL was 97.9°, while the water contact angle of a control without OCL was 85.2°; the device with the OCL thus exhibited a lower surface energy.

EXAMPLE IV

A photoresponsive imaging device incorporating a silicon hardcoat overcoat layer with the same formulation of Example II but containing a lesser amount of the block copolymer (0.1 gram) was fabricated in the same manner as the device in Example II. The OCL thickness was 5.3 microns. The following table summarizes the electrical and the wear test performance of this device.

| Device | $V_{ddp}$ (V) | $E_{1/2}$ (Ergs/cm)$^2$ | Dark Decay (V @ 500 ms) | Vr (V) | WEAR (nm/k cycles) |
|---|---|---|---|---|---|
| Control Device Without OCL | 806 | 1.80 | 8.0 | 3 | 41.5 |
| Device with alumina nanoparticle containing silicon hardcoat OCL | 808 | 2.08 | 8.0 | 4 | 8.5 |

The water contact angle of the device with the OCL was 95.5°, while the water contact angle of a control device (control device same as device with overcoat except control contains no overcoat) without OCL was 85.2°; the device with the OCL exhibited a lower surface energy.

EXAMPLE V

A titanium oxide/phenolic resin dispersion was prepared by ball milling 15 grams of titanium dioxide (STR60N™, Sakai Company), 20 grams of the phenolic resin (VARCUM™ 29159, OxyChem Company, $M_w$ about 3,600, viscosity about 200 cps) in 7.5 grams of 1-butanol and 7.5 grams of xylene with 120 grams of 1 millimeter diameter sized $ZrO_2$ beads for 5 days. Separately, a slurry of $SiO_2$ and a phenolic resin was prepared by adding 10 grams of $SiO_2$ (P100, Esprit) and 3 grams of the above phenolic resin into 19.5 grams of 1-butanol and 19.5 grams of xylene. The resulting titanium dioxide dispersion was filtered with a 20 micrometer pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$/VARCUM™ dispersion. Additional solvents of 5 grams of 1-butanol, and 5 grams of xylene; 2.6 grams of bisphenol S(4,4'-sulfonyl-diphenol), and 5.4 grams of the above prepared $SiO_2$/VARCUM™ slurry were added to 50 grams of the above resulting titanium dioxide/VARCUM™ dispersion, referred to as the coating dispersion. Then an aluminum drum, cleaned with a detergent and rinsed with deionized water, was dip coated with the coating dispersion at a pull rate of 160 millimeters/minute, and subsequently, dried at 160° C. for 15 minutes, which resulted in an undercoat layer (UCL) comprised of $TiO_2$/$SiO_2$/VARCUM™/bisphenol S with a weight ratio of about 52.7/3.6/34.5/9.2 and a thickness of 3.5 microns.

A 0.5 micron thick photogenerating layer was subsequently dip coated on top of the above generated undercoat layer from a dispersion of Type V hydroxygallium phthalocyanine (12 parts), alkylhydroxy gallium phthalocyanine (3 parts), and a vinyl chloride/vinyl acetate copolymer, VMCH ($M_n$=27,000, about 86 weight percent of vinyl chloride, about 13 weight percent of vinyl acetate and about 1 weight percent of maleic acid) available from Dow Chemical (10 parts), in 475 parts of n-butylacetate.

Subsequently, a 24 μm thick charge transport layer (CTL) was coated on top of the photogenerating layer from a solution of N,N'-diphenyl-N,N-bis(3-methylphenyl)-1,1'-biphenyl-4,4'-diamine (3.6 grams) and the polycarbonate, PCZ-400 [poly(4,4'-dihydroxy-diphenyl-1-1-cyclohexane), $M_w$=40,000] available from Mitsubishi Gas Chemical Company, Ltd., (5.4 grams) in a mixture of 21.6 grams of tetrahydrofuran (THF), and 7.2 grams of toluene. The CTL was dried at 120° C. for 45 minutes.

The silicon hardcoat overcoat layer of Example II was coated on the top of CTL by ring coating resulting in a 3.3 microns thick layer.

For the wear test, the resulting photoreceptor drum was mounted in a xerographic customer replacement unit (CRU) and set into the wear test fixture for a 100,000 cycle wear test. The wear test fixture consisted of a CRU, power supplies for BCR (Biased Charged Roll), development roll (DR), a LED for light exposure, and a control unit to control the charging times of BCR, DR and LED and the rotation of the photoreceptor test device. The CRU was comprised of the photoreceptor, cleaning blade, a BCR, a DR, and a toner cartridge. The timing was set such that the photoreceptor was rotated for 10 cycles in 8 seconds and off (stop the rotation) for 1 second. During the 10 cycle rotation, the BCR was powered with a 2,100 volt peak to peak AC voltage with a −450 volt DC bias. The DR was on for 300 msec after the BCR charging was disengaged. The LED was turned on for 500 msec, 2 seconds after the DR was turned on. For each 10 cycle run, the photoreceptor was charged to −450 volt surface voltage for close to 8 seconds and developed with the black toner of Example I, and then cleaned with a blade. The 10 cycle experiment was repeated for 10,000 times and the photoreceptor was subject to a total of 100,000 cycles in the wear fixture. The following table summarizes the electrical and the wear test performance of this device.

| Device | $V_{ddp}$ (V) | $E_{1/2}$ (Ergs/cm)$^2$ | Dark Decay (V @ 500 ms) | Vr (V) | WEAR (nm/k cycles) |
|---|---|---|---|---|---|
| Control Device Without OCL | 806 | 1.80 | 8.0 | 3 | 88 |
| Device with alumina nanoparticle containing silicon hardcoat OCL | 808 | 2.08 | 8.0 | 4 | 22.6 |

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A photoconductive member comprised of a substrate, a photogenerating layer, a charge transport layer, and an overcoat layer wherein said overcoat layer is comprised of a crosslinked siloxane composite containing a caprolactone-siloxane copolymer group.

2. A photoconductive member in accordance with claim 1 wherein said caprolactone-siloxane copolymer is of the formula

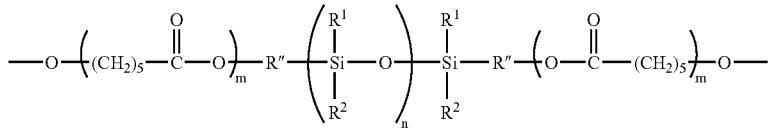

wherein $R^1$ and $R^2$ are each selected from the group consisting of an alkyl optionally with from 1 to about 6 carbon atoms, a vinyl, and a phenyl; R" represents a divalent linkage organic group; m and n represent the number of repeating segments, wherein m is from about 1 to about 100, and n is from about 1 to about 100.

3. A photoconductive member in accordance with claim 2 wherein said divalent linkage group R" is selected from the group consisting of an alkylene optionally with from about 1 to about 30 carbon atoms, or an arylene optionally with from about 6 to about 30 carbon atoms.

4. A photoconductive member in accordance with claim 2 wherein R" is selected from the group consisting of methylene, dimethylene, trimethylene, tetramethylene, pentamethylene, hexamethylene, octamethylene, phenylene, biphenylene, methylenephenylene, phenyldimethylene, and oxydiphenylene.

5. A photoconductive member in accordance with claim 2 wherein the weight average molecular weight $M_w$ of said copolymer is from about 300 to about 20,000.

6. A photoconductive member in accordance with claim 1 wherein said caprolactone-siloxane copolymer is of the formula

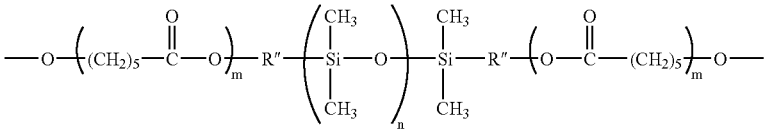

wherein R" represents a divalent linkage organic group; m and n represent the number of repeating segments, wherein m is from about 5 to about 100, and n is from about 10 to about 50.

7. A photoconductive member in accordance with claim 6 wherein the weight average molecular weight $M_w$ of said copolymer is from about 300 to about 20,000.

8. A photoconductive member in accordance with claim 1 wherein said overcoat is comprised of a crosslinked siloxane composite formed by a reaction of a silane compound, a hole transport component, and a caprolactone-siloxane copolymer of the formula

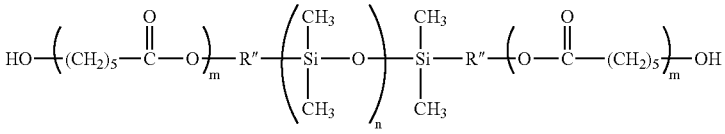

wherein R" represents a divalent linkage organic group; m and n represent the number of repeating segments, wherein m is from about 5 to about 100, and n is from about 10 to about 50.

9. A photoconductive member in accordance with claim 8 wherein said silane compound is of Formula (III) or (IV)

$$R—Si(X)_nY_{3-n} \quad (III)$$

$$Y_{3-n}(X)_nSi—R'—Si(X)_nY_{3-n} \quad (IV)$$

wherein R and X each independently represents an organic group with a carbon atom directly bonded to silicon atom; R' represents a divalent organic group; Y represents a hydrolyzable group; and n is an integer of 0, 1 and 2.

10. A photoconductive member in accordance with claim 9 wherein R and X are each independently selected from the group consisting of an alkyl with carbon atoms from about 1 to about 30, a halogen-substituted alkyl with carbon atoms from about 1 to about 30, and an aryl having carbon atoms from about 6 to about 60.

11. A photoconductive member in accordance with claim 9 wherein R and X are each independently selected from the group consisting of a methyl, an ethyl, a propyl, a butyl, a trifluoromethyl, a trifluoroethyl, trifluoropropyl, and tridecafluoro-1,1,2,2-tetrahydrooctyl.

12. A photoconductive member in accordance with claim 9 wherein R and X are each independently selected from the group consisting of γ-glycidoxypropyl, β-(3,4-epoxycyclohexyl)ethyl, a γ-hydroxypropyl, a γ-acryloxypropyl, a γ-methacryloxypropyl, a vinyl, and a propenyl.

13. A photoconductive member in accordance with claim 9 wherein R' represents a divalent organic group selected from the group consisting of an alkylene with carbon atoms from 1 to about 30, and an arylene with carbon atoms from about 6 to about 30.

14. A photoconductive member in accordance with claim 9 wherein said R' is selected from the group consisting of methylene, dimethylene, trimethylene, tetramethylene, pentamethylene, hexamethylene, phenylene, and biphenylene.

15. A photoconductive member in accordance with claim 9 wherein Y is selected from the group consisting of a methoxy, an ethoxy, a propoxy, a butoxy, an acetoxy and an allyl group.

16. A photoconductive member in accordance with claim 9 wherein said silane compound of Formula (I) is selected from the group consisting of methyltrimethoxysilane, ethyltrimethoxysilane, propyltrimethoxysilane, methyltriethoxysilane, octyltrimethoxysilane, and phenyltrimethoxysilane.

17. A photoconductive member in accordance with claim 9 wherein said silane compound of Formula (II) is selected from the group consisting of

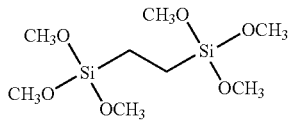

-continued

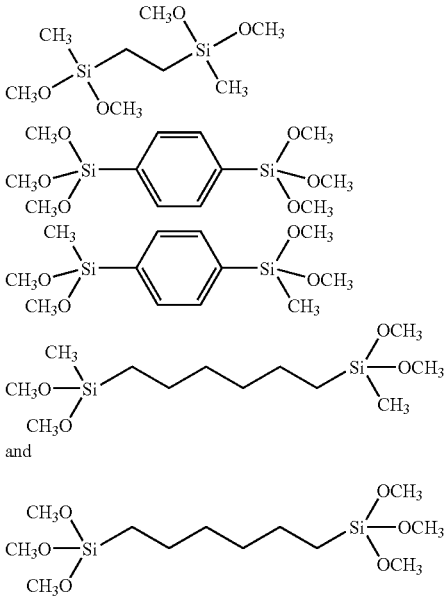

and

18. A photoconductive member in accordance with claim 8 wherein said hole transporting component is selected from Formula (V) or (VI)

$$A—(Z—OH)_m \quad (V)$$

$$A—[Z—Si(X)_nY_{3-n}]_m \quad (VI)$$

wherein A represents a charge transport moiety; Z represents a single bond linkage or a divalent linkage organic group; X represents an organic group with a carbon atom directly bonded to silicon atom; Y represents a hydrolyzable group; n is 0, 1 and 2, and m is a number selected from about 1 to about 5.

19. A photoconductive member in accordance with claim 18 wherein A is selected from the group consisting of the following formula structures

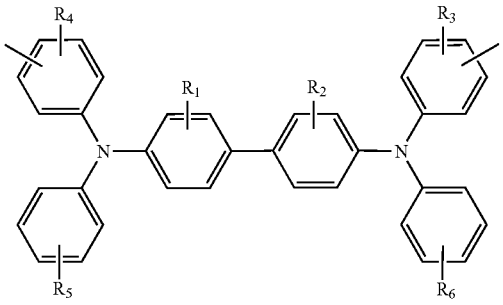

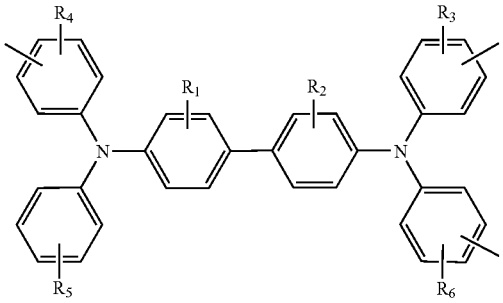

-continued

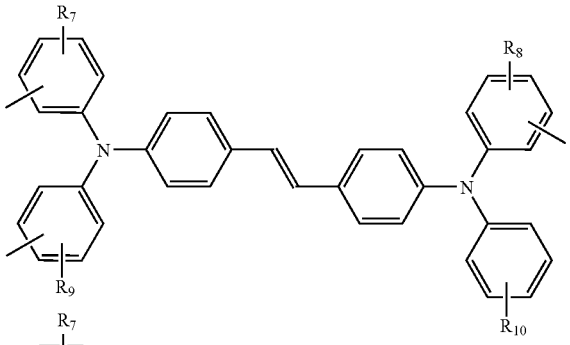

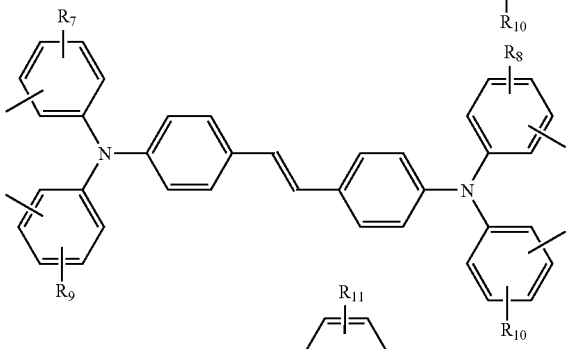

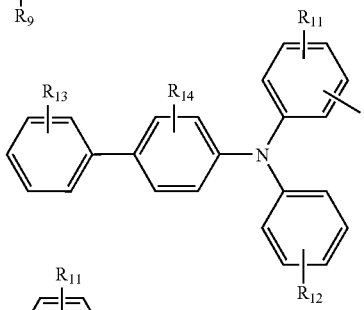

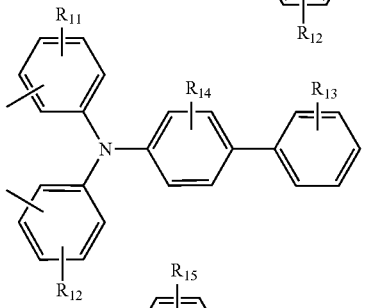

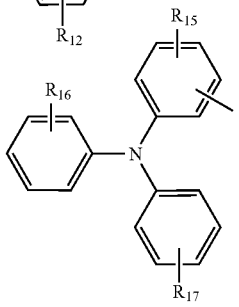

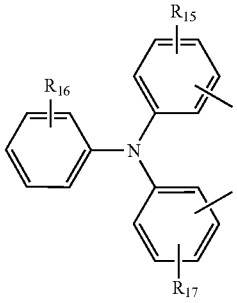

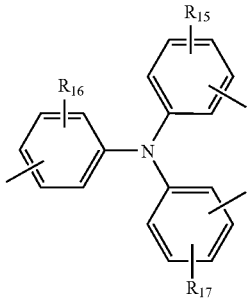

-continued

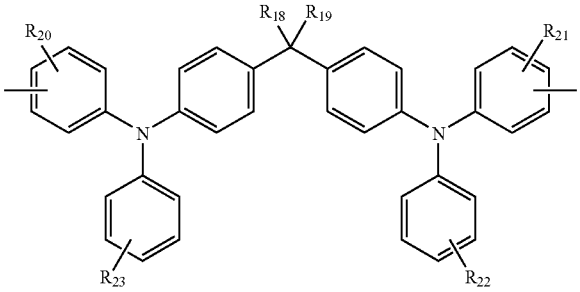

and

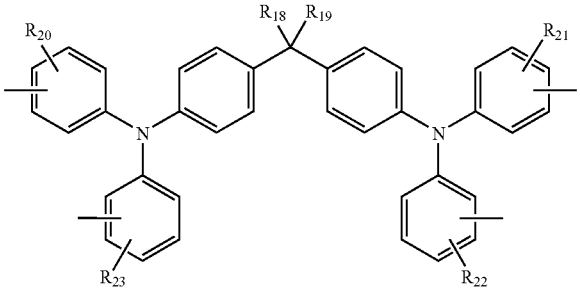

wherein $R_1$ to $R_{23}$ are independently selected from a hydrogen atom, an alkyl, a cyclic alkyl, and a halogen atom.

20. A photoconductive member in accordance with claim 8 wherein said silane compound is present in said overcoat layer in an amount of from about 20 to about 80 weight percent; said caprolactone-dimethylsiloxane block copolymer is present in an amount of from about 0.1 to about 20 weight percent; said hole transport molecule is present in an amount of from about 5 to about 60 weight percent; the total amount of all components in the crosslinked siloxane composite equals about 100 weight percent.

21. A photoconductive member in accordance with claim 1 wherein said composite further contains metal oxide filler.

22. A photoconductive member in accordance with claim 21 wherein said metal oxide filler is comprised of aluminum oxide, silicon oxide and titanium oxide particles with a size diameter ranging from about 1 to about 250 nanometers.

23. A photoconductive member in accordance with claim 21 wherein said metal oxide is of a nanoparticle size and is present in said overcoat layer in an amount of from about 0.1 to about 50 percent by weight of total solids.

24. A photoconductive member comprised of a substrate comprised of a conductive metal of aluminum, aluminized polyethylene terephthalate or titanized polyethylene terephthalate; a photogenerating layer comprised of hydroxygallium phthalocyanine or chlorogallium phthalocyanine; a charge transport layer containing N,N'-diphenyl-N,N-bis(3-methyl phenyl)-1,1'-biphenyl-4,4'-diamine and/or N,N-bis(3,4-dimethyl phenyl)-N-biphenylamine, and a binder of a polycarbonate; and an overcoat layer, wherein said overcoat layer is comprised of a crosslinked siloxane composite containing a caprolactone-siloxane copolymer group of the formula

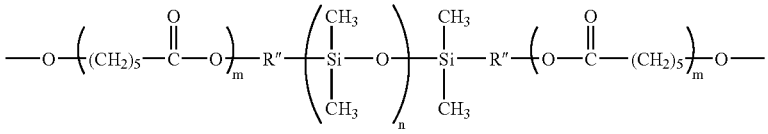

wherein R" represents a divalent linkage organic group, m is from about 10 to about 50, and n is from about 10 to about 50.

25. A photoconductive component comprised of a photogenerating layer, a charge transport layer, and an overcoat layer wherein said overcoat layer is comprised of a crosslinked siloxane composite containing a caprolactone-siloxane polymer, and wherein said caprolactone-siloxane copolymer is of the formula

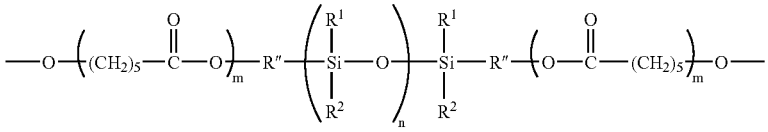

wherein $R^1$ and $R^2$ are each alkyl, aryl; R" represents an organic component; and m and n represent the number of repeating groups.

* * * * *